US010024100B2

(12) United States Patent
Meng

(10) Patent No.: US 10,024,100 B2
(45) Date of Patent: Jul. 17, 2018

(54) MAGNETICALLY ACTUATED DOOR SEAL

(71) Applicant: Cmech (Guangzhou) Ltd., Guangdong (CN)

(72) Inventor: Chen Yuan Meng, Yangjian (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 0 days.

(21) Appl. No.: 15/138,590

(22) Filed: Apr. 26, 2016

(65) Prior Publication Data

US 2017/0306692 A1 Oct. 26, 2017

(51) Int. Cl.

| | |
|---|---|
| ***E06B 7/21*** | (2006.01) |
| ***E06B 7/215*** | (2006.01) |
| ***E06B 7/23*** | (2006.01) |
| *E06B 7/20* | (2006.01) |

(52) U.S. Cl.

CPC ..... *E06B 7/21* (2013.01); *E06B 7/215* (2013.01); *E06B 7/2316* (2013.01); *E06B 7/2312* (2013.01); *E06B 2007/202* (2013.01)

(58) Field of Classification Search

CPC ..... E06B 7/21; E06B 7/22; E06B 7/202
See application file for complete search history.

(56) References Cited

U.S. PATENT DOCUMENTS 4,703,586 A * 11/1987 Smith ..... E06B 7/20 49/303
4,947,584 A * 8/1990 Wexler ..... E06B 7/215 49/307
5,964,060 A * 10/1999 Furlong ..... E06B 7/21 49/320
6,082,047 A * 7/2000 Comaglio ..... E06B 7/215 49/303
6,125,584 A * 10/2000 Sanders ..... E06B 7/215 49/310
7,624,539 B2 * 12/2009 Speyer ..... E05C 9/063 49/316
7,665,245 B2 * 2/2010 Speyer ..... E05C 9/063 49/303
2007/0022663 A1 * 2/2007 Faflek ..... E06B 7/21 49/306
2011/0126471 A1 * 6/2011 Hans ..... E05D 15/06 49/409
2013/0219792 A1 * 8/2013 Parker ..... E06B 7/21 49/306
2015/0121759 A1 * 5/2015 Dintheer ..... E06B 7/02 49/70
2015/0233175 A1 * 8/2015 Parker ..... E06B 7/215 49/304

FOREIGN PATENT DOCUMENTS

FR 2 712 346 * 5/1995

* cited by examiner

*Primary Examiner* — Gregory J Strimbu
(74) *Attorney, Agent, or Firm* — McKee, Voorhees & Sease, PLC

(57) ABSTRACT

An automatic door seal seals the gap between the lower edge of a door and a threshold. The seal is magnetically actuated so as to move downward into sealing engagement with the threshold when the door is closed and raises out of engagement when the door is opened. A transmission assembly converts horizontal movement from the magnetic force into vertical movement for the seal. Springs provide a reset force when the magnetic force is eliminated so as to retract the seal strip whenever the door is moved from the closed position.

16 Claims, 5 Drawing Sheets

MAGNETICALLY ACTUATED DOOR SEAL

FIELD OF THE INVENTION

The present utility model relates to the field of door accessories, particularly to a self-lifting sealing apparatus mounted at the bottom of the door.

BACKGROUND OF THE INVENTION

Exterior doors often include seals to provide a substantially air tight and weatherproof barrier when the door is closed. There are generally two types of sealing apparatus, fixed and lifting, mounted at the bottom of a door. The fixed sealing strip maintains contact with the ground when opening/closing the door, and thus increases the resistance for the door, and affects how well the door closer operates. This fixed sealing strip is easily damaged. The lifting sealing apparatus is more complex. When the door opens, a sealing strip lifts off the threshold; when the door is closed to a predetermined position, the sealing strip descends to the threshold for sealing engagement, with a lifting seal, the resistance for opening/closing the door is decreased, thus facilitating the operation of the door closer.

The lifting type sealing apparatus is usually equipped with a press mechanism which is mounted adjacent to the door hinge. When the door is closed, the door frame actuates the press mechanism, whereby a transmission mechanism is driven to descend the sealing strip. This lifting type sealing apparatus lifts and descends easily. However, there still has a drawback that the sealing strip may contact the ground even if the door has not yet been closed completely, thus causing the sealing strip to drag on the ground along a distance, and preventing the door from closing completely, so that the latch bolt of the door lock cannot be inserted in the door frame buckle entirely.

Therefore, it is desirable to provide a self-lifting sealing apparatus to solve the above-described problems, so that the sealing strip descends when the door is closed, and which eliminates or minimizes the possibility of the sealing strip dragging on the ground.

Accordingly, a primary objective of the present invention is the provision of an improved self-lifting sealing apparatus for the bottom edge of a door.

Another objective of the present invention is the provision of a self-lifting door weather stripping seal which overcomes the problems of the prior art.

A further objective of the present invention is the provision of a door seal which automatically lowers when the door is closed and automatically lifts when the door is opened.

Still another objective of the present invention is the provision of a method of sealing a gap between the lower edge of a door and a door frame threshold wherein the seal moves between a raised position when the door is opened and a lowered position when the door is closed.

Yet another objective of the present invention is the provision of an automatic door seal having an actuation mechanism opposite the door hinge.

Another objective of the present invention is the provision of a self-lifting sealing apparatus for a door which is magnetically actuated.

A further objective of the present invention is a self-lifting door seal which is economical to manufacture, automatic in operation, and durable in use.

These and other objectives will become apparent from the following description of the invention.

SUMMARY OF THE INVENTION

The self-lifting sealing apparatus of the present invention comprises in inverted U-shaped holder fixed in a channel in the bottom edge of the door. The holder has a downwardly facing opening, with a transmission assembly mounted within the holder to transform horizontal movement into vertical movement. The transmission assembly includes a rod and a batten bar slidably mounted in the holder for horizontal movement. A sealing strip is mounted to the batten bar by a plurality of link arms which allow vertical movement of the sealing strip relative to the holder.

The self-lifting sealing apparatus further comprises a first magnet mounted on the end of the batten bar and a second magnet mounted in the door frame opposite the first magnet when the door is closed. A first compression spring on the batten bar exerts a reset force in the direction opposite the attractive magnetic forces of the first and second magnets, which have opposite magnetic polarity.

The magnetic force between the first and second magnets when the door is closed causes the batten bar to slide toward the door frame. When the door is opened, the first spring slides the batten bar in the opposite direction towards the door hinge.

In an alternative embodiment, the first and second magnets may have the same magnetic polarity, to cause the rod bar to slide horizontally towards the door hinge, with the first spring urging the rod bar in the opposite direction towards the door frame when the door is the opened.

A second linear spring extends between the transmission rod and the batten bar to exert a force on the batten bar to lift the batten bar as the door begins to open and the magnets are not aligned.

In the preferred embodiment, the magnets are mounted on the door and door frame opposite the door hinges. In an alternative embodiment, the magnets are mounted on the hinge side of the door and door frame.

In operation, movement of the transmission rod and batten bar with the sealing strip is controlled by the magnetic force of the magnets. The magnetic force actuates horizontal movement of the transmission rod and vertical movement of the batten bar and seal strip only when the door is closed. When the door is opened, the magnetic force ceases, such that the forces of the first and second springs retract the transmission rod and raise the batten bar and seal strip.

DETAILED DESCRIPTION OF THE INVENTION

Figure 1:
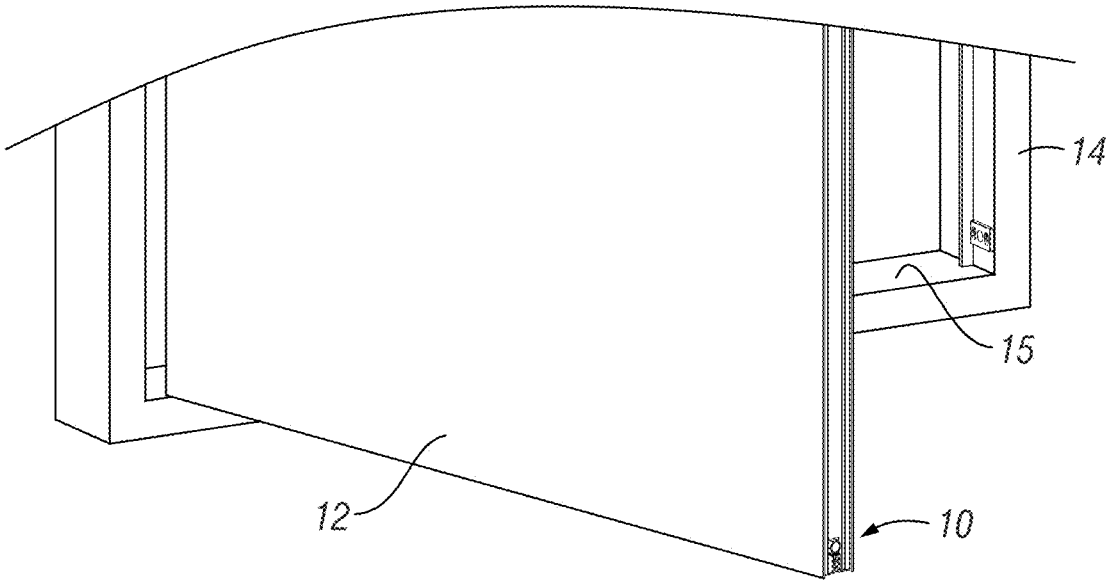
FIG. 1 is a view showing a door and door frame having the self-lifting seal assembly of the present invention.

The self-lifting sealing apparatus of the present invention is generally designated by the reference numeral 10 in drawings. The sealing apparatus 10 is intended for use on the bottom edge of a door 12 mounted by hinges in a door frame 14 for opening and closing movement. The door entryway has a threshold 15 which the sealing apparatus engages when the door 12 is closed to provide a substantially airtight and watertight weather strip seal.

The self-sealing apparatus 10 includes an inverted U-shaped holder or frame 16 mounted in a channel in the bottom edge of the door 12. The frame 16 includes spaced apart legs 18 each having an outwardly turned flange 20 which allows the frame 16 to be screwed or otherwise secured to the bottom edge of the door 12. The legs 18 are spaced apart so as to define a gap or opening 22 therebetween.

A transmission assembly is mounted in the holder or frame 16 and transmits horizontal movement to vertical movement. More particularly, the transmission assembly includes a rod 24 slidably mounted between the legs 18 of the holder 16 for sliding horizontal movement. While the rod 24 can be mounted to the holder 16 in any convenient manner, in the preferred embodiment shown in the drawings, the plurality of blocks 26, 28, 30, each being U-shaped, are welded or fixed to the legs 18 of the holder 16, so as to slidably support the rod 24.

The transmission assembly also includes a batten bar 32 pivotally mounted to the transmission rod 24 by two or move swing arms 34. Each swing arm 34 has an upper end pivotly coupled to the transmission rod 24 by a pin 36, and a lower end pivotally coupled to the batten bar 32 by a pin 38. A seal strip 40 is mounted on and extends downwardly from the batten bar 32. The seal strip 40 may take various forms, and may be mounted to the batten bar 32 in any convenient manner.

Figure 5:
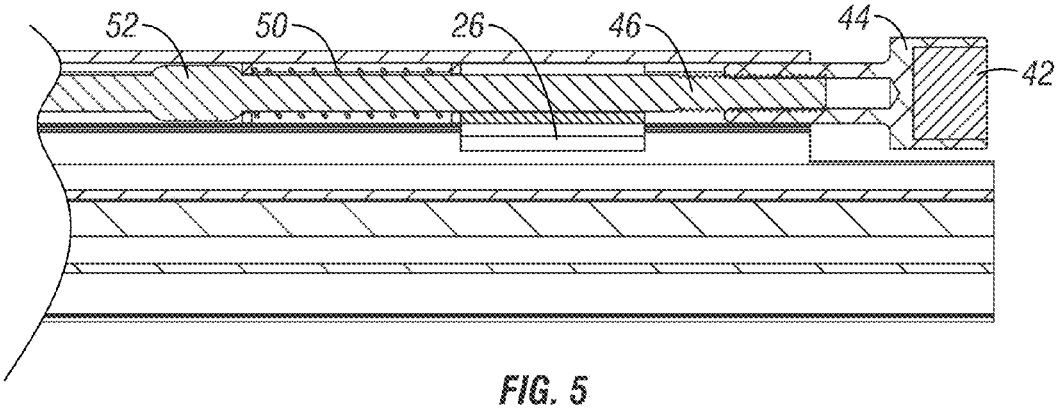
FIG. 5 is an enlarged sectional view of the seal assembly showing the first reset spring.
Figure 6:
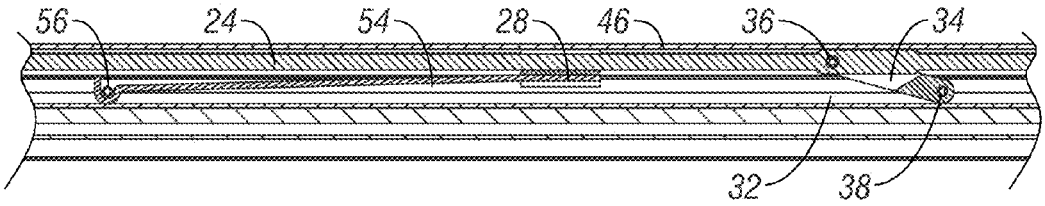
FIG. 6 is an enlarged sectional view showing the second reset spring.

A first magnet 42 is fixed in a holder 44. The neck of the holder 44 is hollow and has internal threads for threaded coupling onto the threaded end 46 of the transmission rod 24, as seen in FIG. 5. The threads of the holder 44 and rod end 46 allow the position of the magnet 42 to be horizontally adjusted.

Figure 3:
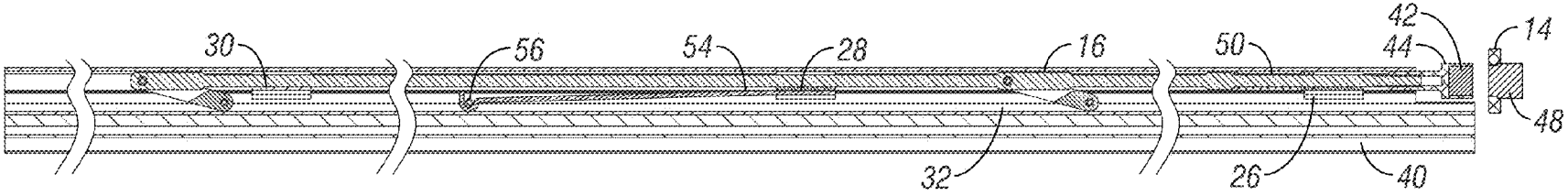
FIG. 3 is a sectional drawing of the seal assembly in a raised position.
Figure 4:
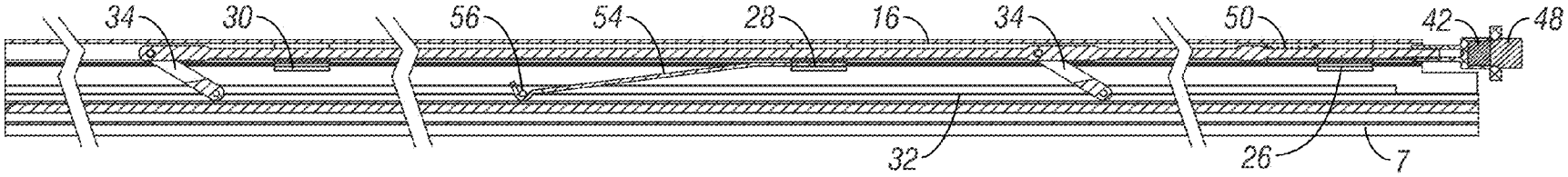
FIG. 4 is a sectional view showing the seal assembly in a lowered position.

A second magnet 48 is mounted in the door frame 14 in alignment with the first magnet 42, shown in FIGS. 1, 3 and 4. Preferably, the magnets 42 and 48 have opposite polarity, so that when the door 12 is closed in to the frame 14, the magnetic force between the magnets 42, 48 pulls the transmission rod 24 horizontally toward the door frame 14. This sliding movement of the transmission rod 24 causes the swing arms 24 to pivot downwardly, thereby moving the batten bar 32 and sealing strip 40 downwardly from the retracted position shown in FIG. 7 to the extended position shown in FIG. 8. In the extended position, the strip 40 provides sealing contact or engagement with the threshold 15 of the door entryway.

A first reset spring 50 is mounted on the transmission rod 24. One end of the spring 50 engages the block 26, while the opposite end of the spring 50 engages a projection 52 of the rod 24, as shown in FIG. 5. In the preferred embodiment, the spring 50 is a compression spring, although it is understood that alternative springs may be used.

Figure 2:
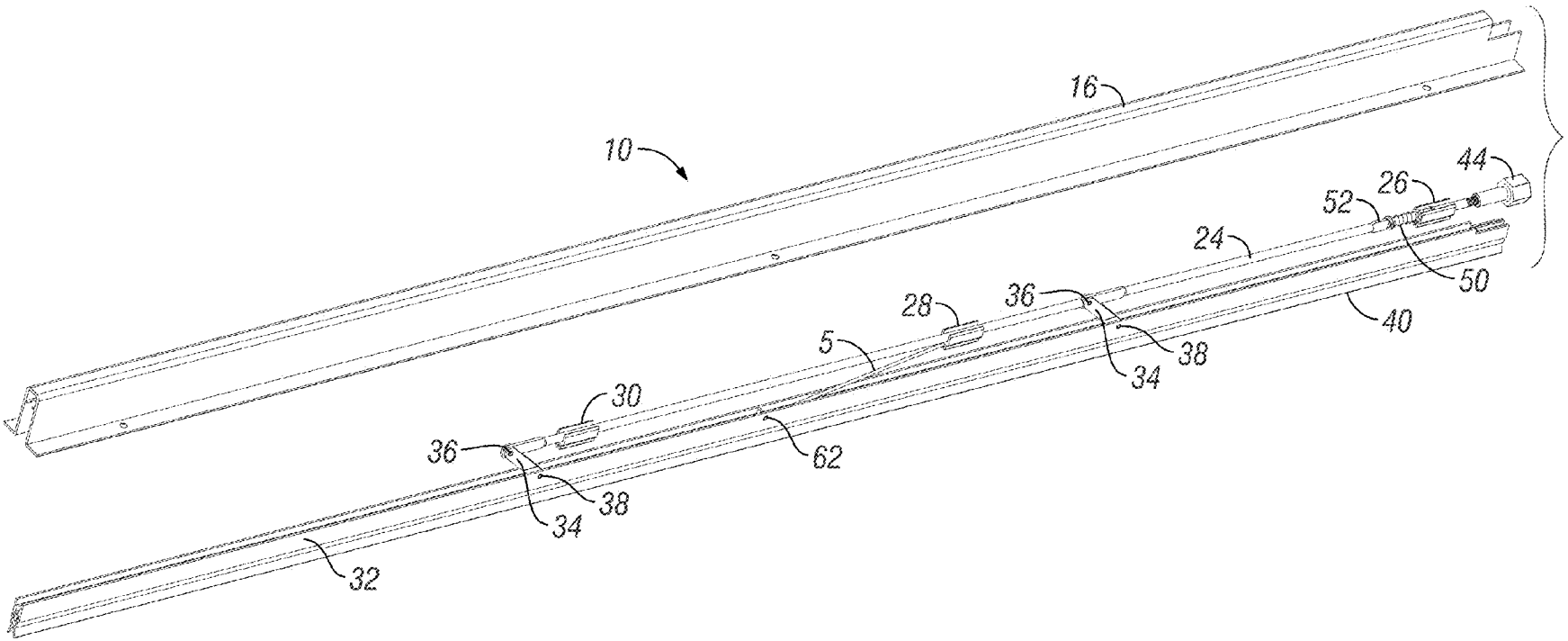
FIG. 2 is an exploded view of the seal assembly.

A second reset spring 54 has one end connected to the block 28 and the opposite end attached to the batten bar 32 by a pin 56, as seen in FIGS. 2-4. The linear spring 54 is preferably made of spring wire, and may be round or flat in cross-section, that will deform under stress. When the batten bar 32 and seal strip 40 descend upon horizontal movement of the transmission rod 24 in response to the magnetic force between the magnets 42, 48 when the door 12 is closed, the spring 54 bends or deflects. When the magnetic force stops, the spring 54 resets to raise the batten bar 32 and sealing strip 40 upwardly into the holder 16, as the compression spring 50 forces the transmission rod 24 horizontally within the blocks 28, 30. The linear spring 54 also prevents the batten bar 32 from moving horizontally. As an alternative to the spring wire shown for the second spring 54, the second spring may be a tension spring to upwardly reset the batten bar 32.

Figure 7:
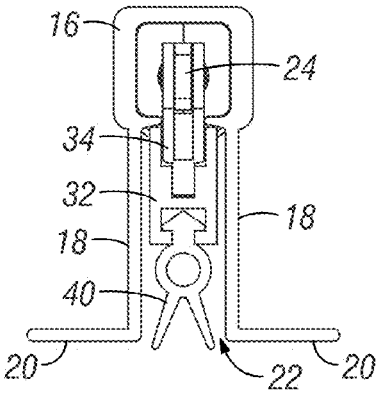
FIG. 7 is an end view of the sealing strip of the present invention in a lifted or retracted position.
Figure 8:
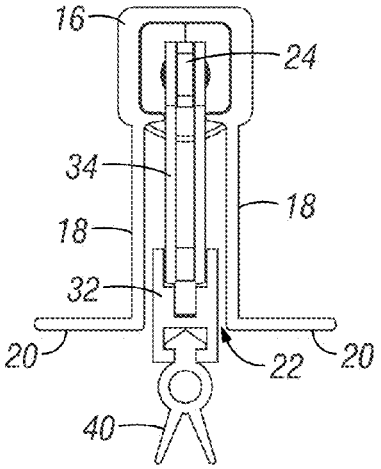
FIG. 8 is an end view of the sealing strip in a lowered position.

When the door 12 moves from the closed position to the open position, the attractive magnetic force between the magnets 42, 48 ceases such that the spring 50 retracts the transmission rod 24 and the spring 54 lifts the batten bar 32, and seal strip 40 moves from the position shown in FIG. 8 to the position shown in FIG. 7. Thus, as the door 12 begins to open, the sealing strip 40 disengages from the threshold 15 thereby minimizing wear on the sealing strip 40 as the door swings open and closed.

In the preferred embodiment, the magnets 42, 48 are mounted opposite the door hinges. Alternatively, the magnets 42, 48 can be mounted on the hinge side of the door 12 and door frame 14.

In the preferred embodiment, the magnets 42, 48 have opposite polarity, such that the transmission rod 24 is pulled toward the door frame 14 as the door 12 closes. Alternatively, the magnets 42, 48 can have the same polarity, such that the transmission rod 24 is pushed horizontally away from the door frame 14 when the door 12 is closed, so as lower the batten bar 32 and the seal strip 40. In both instances, the magnetic force between the magnets 42, 48 is greater that the force of the reset springs 50, 54.

As a further alternative, the spring 54 can be eliminated, in which case stoppers are provided to preclude horizontal movement of the batten bar 32.

What is claimed is:

1. A self-lifting sealing apparatus for a bottom edge of a door and a threshold of a door frame, comprising:

a holder with a downward opening and mounted in a channel in the bottom edge of the door between interior and exterior surfaces of the door;

a magnetically actuated transmission assembly mounted in the holder;

a first magnet at one end of the transmission assembly;

a second magnet mounted on the door frame;

a sealing strip extending downwardly from the. transmission assembly;

wherein the transmission assembly moves automatically in response to an absence of a magnetic force between the magnets to a first horizontal position as the door is partially opened away from the door frame causing the sealing strip to move into a raised position within the holder and moves automatically when the magnetic force is present between the magnets to a second horizontal position after the door is closed causing the sealing strip to move into a lowered position below the holder.

2. The self-lifting sealing apparatus of claim 1 further comprising a first reset spring to exert a reset force on the transmission assembly opposite the magnetic force.

3. The self-lifting sealing apparatus of claim 2 wherein the first reset spring urges the sealing strip toward the raised position.

4. The self-lifting sealing apparatus of claim 2, further comprising a second reset spring to exert an upward pull force on the sealing strip.

5. The self-lifting sealing apparatus of claim 2 wherein the transmission assembly includes a horizontally slidable rod extending through the first reset spring and having the first magnet mounted on the rod.

6. The self-lifting sealing apparatus of claim 5 further comprising swing arms having upper ends pivotally connected to the rod and lower ends supporting the sealing strip.

7. The self-lifting sealing apparatus of claim 1, wherein the transmission assembly comprises a transmission rod, a batten bar, and swing arms hinged to the transmission rod and the batten bar.

8. The self-lifting sealing apparatus of claim 7, wherein the transmission rod is connected to the first magnet through a threaded connection.

9. The self-lifting sealing apparatus of claim 8, wherein the transmission rod slides horizontally within the holder.

10. The self-lifting sealing apparatus of claim 1 wherein the door has opposite first and second vertical edges, and the door is hinged along the first edge, and the first magnet is adjacent the second edge.

11. A method of sealing a gap between a lower edge of a door mounted in a door frame and a threshold of an entryway, the door having a pivot edge hinged to the door frame and an opposite edge adjacent the door frame when the door is closed and the door having a seal mounted in a recess in the lower edge of the door, the seal being movable between a raised position when the door is opened and a lowered position when the door is closed, the method comprising:

automatically moving the seal to the lowered position by a magnetic force between a first magnet in the opposite edge of the door and a second magnet in the door frame after the door is closed, and automatically moving the seal to the raised position by a spring force when the magnetic force is absent between the first and second magnets after the door begins to pivot open with the opposite edge moved away from the door frame.

12. The method of claim 11 wherein the movement of the seal is generated by a horizontally moving transmission assembly.

13. An automatic door seal for sealing a gap between a lower edge of a door mounted in a door frame and a threshold of an entryway, the door having a pivot edge hinged to the door frame and an opposite edge adjacent the door frame when the door is closed, the door seal comprising:

a seal mounted in a recess in the lower edge of the door and being automatically movable between a lowered position when the door is closed and a raised position when the door is open;

magnets mounted in the door and in the door frame to move the seal to the lowered position in response to a magnetic force between the magnets;

a spring attached to the seal to move the seal to the raised position;

the seal being automatically moved to the raised position when the magnetic force between the magnets is absent as the door begins to pivot open and automatically moved to the lowered position when the magnetic force between the magnets is present after the door is closed.

14. The automatic door seal of claim 13 further comprising a transmission assembly connected to the seal and being movable horizontally in response to alignment and misalignment of the magnets so as to move the seal between the raised and lowered positions.

15. The automatic door seal of claim 14 wherein the transmission assembly is mounted in the recess in the lower edge of the door.

16. The automatic door seal of claim 13 wherein the spring is in the recess in the lower edge of the door to bias the seal to the raised position.

* * * * *